US008043162B2

(12) United States Patent
Sery

(10) Patent No.: US 8,043,162 B2
(45) Date of Patent: Oct. 25, 2011

(54) GOLF TRAINING DEVICE

(76) Inventor: Joseph Sery, San Diego, CA (US)

( * ) Notice: Subject to any disclaimer, the term of this patent is extended or adjusted under 35 U.S.C. 154(b) by 21 days.

(21) Appl. No.: 12/657,784

(22) Filed: Jan. 28, 2010

(65) Prior Publication Data

US 2011/0183769 A1 Jul. 28, 2011

(51) Int. Cl.
*A63B 69/36* (2006.01)

(52) U.S. Cl. ..... 473/212; 473/226; 473/227

(58) Field of Classification Search ..... 473/201, 473/206, 207, 212, 213, 214, 219, 226, 227, 473/229, 257, 266, 276, 422, 461, 463, 464
See application file for complete search history.

(56) References Cited

U.S. PATENT DOCUMENTS 5,174,575 A * 12/1992 Leith et al. ..... 473/213
5,743,805 A * 4/1998 Richter ..... 473/213
2009/0176592 A1 * 7/2009 Sery ..... 473/213

* cited by examiner

*Primary Examiner* — Nini Legesse

(57) ABSTRACT

A swing training device which positively prevents a player's wrists from uncocking until a desired point the swing is reached.

6 Claims, 11 Drawing Sheets

GOLF TRAINING DEVICE

FIELD OF THE INVENTION

This invention relates to a swing training device for golf clubs, tennis rackets, baseball bats, or the like, which enables a user to feel the correct timing and level of the hinging (cocking) and un-hinging (uncocking) of the wrist during the swing.

BACKGROUND OF THE INVENTION

Sports such as golf, baseball, hockey and tennis require the holding and swinging of a shaft or handle (which maybe a club, racket or a stick) to hit an object (which may be a ball or a puck), with a high swing speed that generates strong force. The swinging of that shaft or handle be it a baseball bat, golf club, hockey stick or a tennis racket requires skill and a lot of practice, over a long period of time in order to do it well. Some of the problems are that such swing occurs so fast and is so complex with so many body parts moving simultaneously that it is impossible to figure out how well one is doing it and even more difficult to control the precise timing of these complex movements.

PRIOR ART

During the swing the player takes the club, bat or racket backwards and then with a fast forward movement impacts the ball or puck. During the backwards movement the wrist is hinging (cocking) so as to create a longer backswing distance and an increased stored energy so that the forward movement can be faster and stronger. During the forward portion of the swing the wrist must become un-hinged. To those who are skilled in the art of swinging a club it is well known that the timing of un-hinging of the wrists is a major contribution to a good swing. There are many swing training devices on the market giving audible and visual indications of some portion of the swing. None of these training devices controls a desired precise timing of the un-hinging of the wrist by restricting such movement until the precise movement of time during the swing when the restriction is released so as to allow the un-hinging can take place.

BRIEF SUMMARY OF THE INVENTION

The present invention comprises a swing training device, which is adapted to be secured to the arm of the person making the swing and attached to the shaft of a sport club, such as a golf club, a hockey stick, a tennis racket, a baseball bat or the like.

The swing training device comprises four major components: a club or racket, a main body, a cord or linear connector and a control lever. The main body of the training device is attached to the arm of the swinger. A special cord or other linear element is connected to the swinging club and routed along or through the main body of the device. The fourth main component of this device is a control lever that extends outward from the main body generally toward the torso and has a component which is adjustable.

During the backswing, the wrists hinge (cock) causing the linear element, which is attached to the club, to shift or move linearly relative to the main body of the device. The device is so designed that this shifting of the linear element is possible in one direction only, and such shifting will shorten its length, i.e., in one direction, between the main body of the device and the club or the like and will lock the hinged or cocked wrists in the most extreme rotated position. When the backswing of the arms and the wrist hinging are complete, the swinger will start his/hers forward swing. As the forward swing starts, the locked linear element continues to restrict the unhinging of the wrists. At a predetermined time during the forward swing, i.e., when the still hinged wrists arrive to the desired spatial position, the control lever, extending from the main body of the device on the swinger's arm, makes contact with the torso of the swinger. At this time, the locking of the linear element is released so it can now shift in the opposite direction relative to the main body, allowing un-hinging of the wrists to then occur. The control lever has an adjustable component that can be adjusted to suit each individual swing style, body size and build. After the control lever is activated by body contact to release the cord, it will become latched in an open or release position so that, even when there is no longer contact of the control lever with the body, the control lever will not return to its point of origin.

Once contact between the control lever and the swinger's body occurs, un-hinging of the wrists is no longer restrained, and such takes place as the swing continues to the contact point with the ball or the puck. From there, it follows through to the top of the swing at which time some hinging of the wrist may again occur as the linear element may shift relative to the main body of the device as it does not become locked because the control lever is latched in its release position.

The correct timing of the unhinging of the wrists is the one most important component that contributes the most speed to the swinging of a golf clubhead to create a powerful and a long shot. This is so because, while the hands holding the shaft are traveling only a very short distance, at the same time the head of the club, stick or bat will travel a much longer distance so as to reach a high speed. If the un-hinging of the wrists occurs too early in the forward swing, e.g. just as the hands start to travel forward, the increased speed takes place before the club, stick or bat makes contact with the ball or puck, and as a result, contact is made at a slower than desired speed and with a weaker force.

Many top sport players reach a very high speed at the time of contact simply because of their perfectly timed and what is known as late release. Such late release is by far the most important reason for being able to generate a high speed and powerful swing. It is also one of the most difficult movements to control. The swinger desires to make hard contact as he or she unleashes a powerful blow resulting most often in an early release. The fast speed of the forward swing is also a reason why learning this timing is very difficult. Many sport teachers, coaches and trainers use high speed photo recording equipment to illustrate the timing of the un-hinging to their students. But even with such aid, it is very difficult to repeatedly control the un-hinging timing on every swing. With this invention, such un-hinging can only take place once a fixed position in the forward swing has been reached, resulting in a perfectly repeatable time and position for un-hinging. Many swingers have been known to understand the importance of this late release term but are unable to duplicate it even after making attempts to generate it at slower swing speed. The fast forward swing changes the feeling attained by the slower swing, and error tends to repeat. It is much easier to repeat a movement after performing it many times at the correct swing speed.

Another advantage of this invention is that a swinger can control the degree of the hinging of the wrists on the backswing. A device can be designed to generate a clicking sound as a given degree of hinging takes place between the pivotal lever and the main body of the device on the swinger's arm. The sound may repeat as the lineal travel of the linear element continues each given increment. The higher the degree of rotation—the higher the number of clicking sounds. This enables the swinger to know the degree of hinging of the wrists that he or she achieves. It also gives them an opportunity to repeat it, increase it, or reduce it by attempting to generate the same, a higher or a smaller number of clicking sounds. In another embodiment of this invention, the lock between the cord and the device only occurs at one point of the hinging of the wrists, and at this point a clicking or other sound may occur. This can indicate that the hinging is complete and that a forward swing is ready to commence. This is especially suitable when training for a lower level of wrist hinging.

Hinging is also a very important part of the third part of the swing. The first part of the swing is known as the backswing. The second part of the swing is known as the forward-swing at the end of which a contact with the ball or puck takes place. The third part of a good swing is known as the follow through. This portion of the swing is also critical to ensure a good balance and position which are major contributors to the direction at which the ball or the puck will be traveling after the impact. During the follow through part of the swing, the wrists should again hinge. It is therefore another advantage of this invention which allows the swinger to swing in the correct way and create a clicking sound during the follow through part of the swing, This swing trainer is manifestly for the use by male as well as female sport swingers and for right-handed as well as left-handed sport swingers, and such devices are expected to be marketed with right and left handed models.

DETAILED DESCRIPTION OF THE INVENTION

Figure 1:
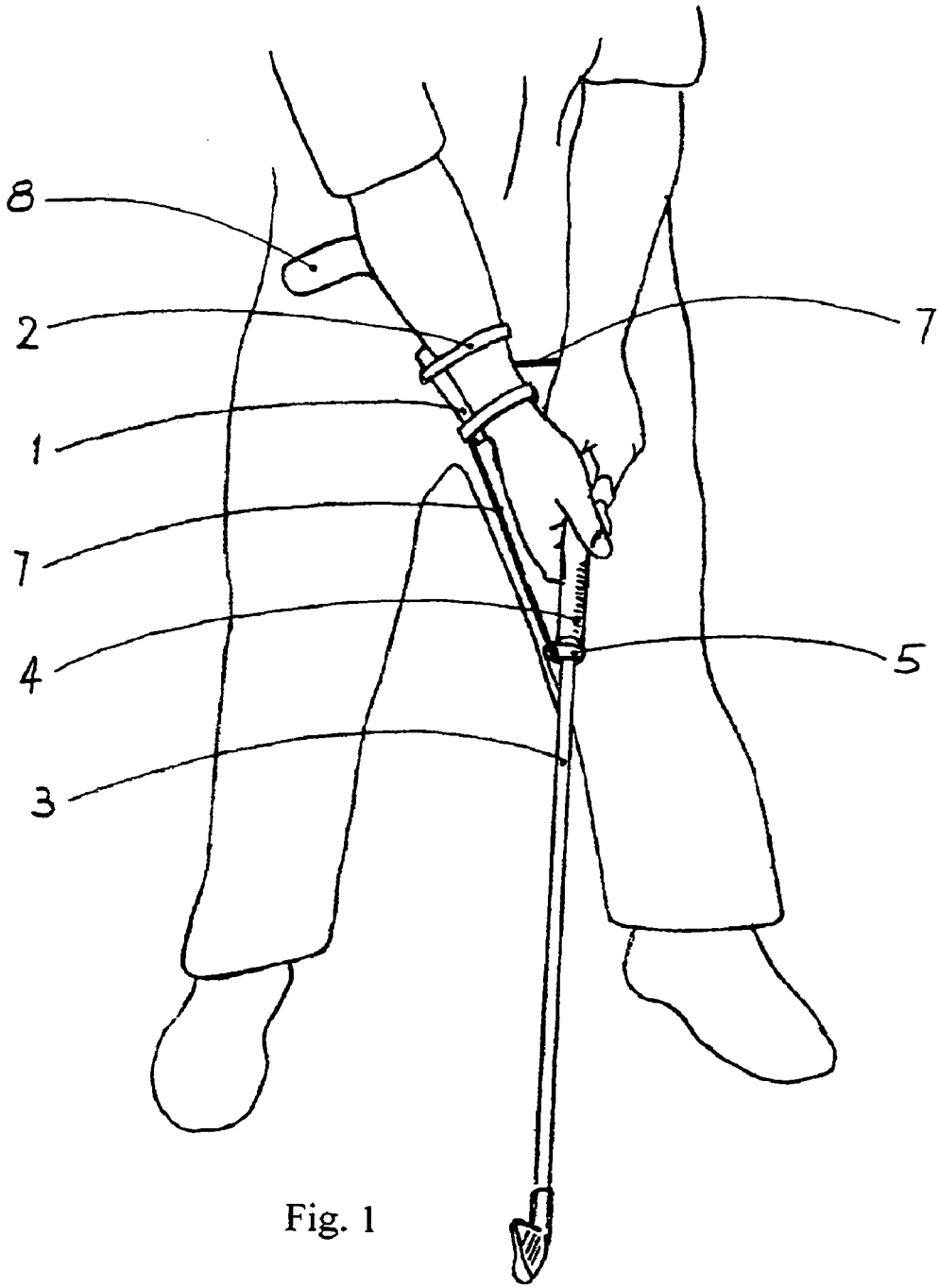
FIG. 1 is a front view of a golfer with a right handed swing training device attached to a golfer's right arm and connected to a golf club at the time of addressing the ball.

In accordance with this invention, FIG. 1 shows a golfer in the address position with the main body 1*a* of the swing trainer device 1 attached by two straps 2 to the back or top surface of the forearm. The golfer is a right handed player, and the swing training devise is attached to the right arm as he/she prepares to start the backswing. The golf club 3 with a grip 4 is made of a special design so as to have two connectors 5 and 6 to which a linear element or special cord 7 can be attached. The connectors flank the grip region with one connector 5 located directly below the grip 4 and the second connector 6 (shown in FIG. 4) located above the grip 4, preferably at the butt end of the club, bat or racket. The special cord 7 is connected to these two connectors 5 and 6 and is routed along or through the main body of the devise 1. A control lever arrangement 8 is shown in its active position wherein the cord 7 is restrained so that it can shift in one direction only.

Figure 2:
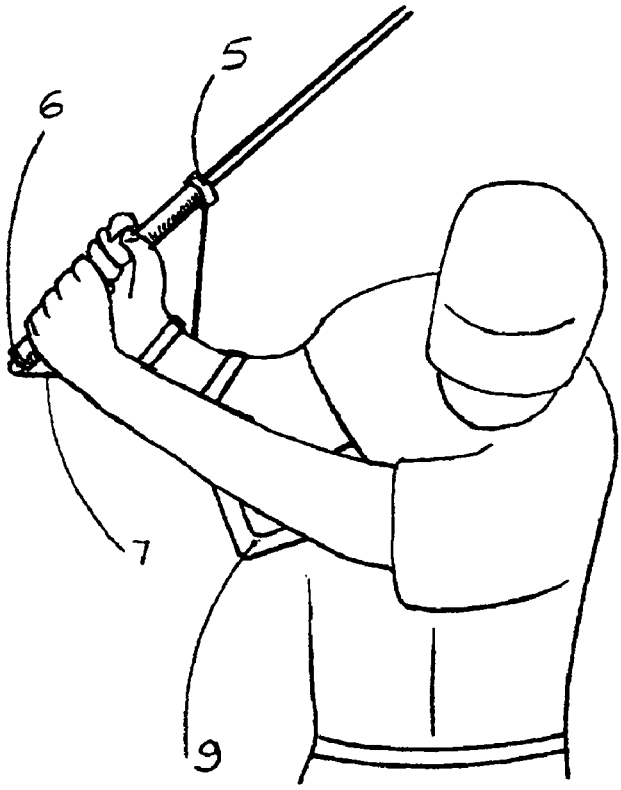
FIG. 2 is a front view showing the fully hinged position at the top of the backswing when the linear element is locked in its most highly shifted position.

At the top of the backswing, as shown in FIG. 2, the cord 7 has shifted linearly relative to the devise, and it is now locked in position with only a minimal length between the connector 6 and the main body and with the cord restrained from moving in the opposite direction. The wrists are fully hinged, and the only possible forward movement from this position is downward movement of the arms with the fully hinged position of the wrists being maintained. This is a very important stage when the swinger will be able to feel the correct start of the forward and downward swinging action.

Figure 3:
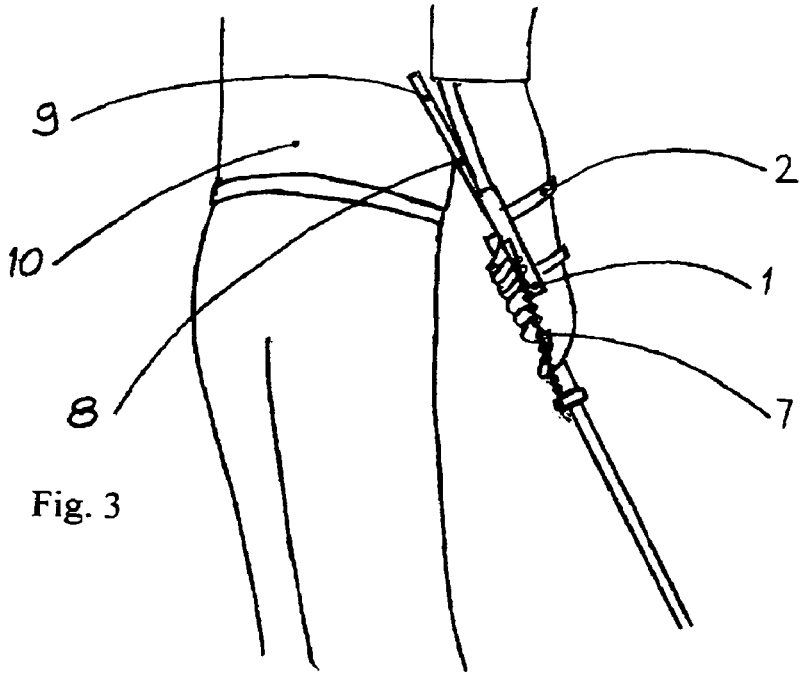
FIG. 3 is a view taken from the right side and rear showing the position when contact between the control lever and the body of the golfer occurs at the exact point in the forward swing when it is desired that the lock be released so the golfer can start un-hinging the wrists to accelerate the club-head.

FIG. 3 shows the position at which the cord's lock is released. The control lever arrangement 8 has an adjustable component 9 which is so positioned that the adjustable component of the lever will make contact with the torso 10 of the swinger at the predetermined position in the swing when unhinging should occur. This contact will shift the lever 8 and release the locking of the special cord 7. The wrists will then be free to un-hinge so that contact with the ball will occur with the club-head moving at high speed. If the swinger feels that the release took place too early or too late for his liking he/she can simply adjust the adjustable component 9 of the control lever 8 so that a slightly earlier or later contact with the body 10 will occur and thus change the timing of release.

Once the control lever 8 has been pivoted by the momentary body contact to a new release position, it will not return to its original active position because it becomes latched in this release. At this release position, the control lever 8 has no ability to lock the cord, and the cord is free to shift in both directions.

Figure 4:
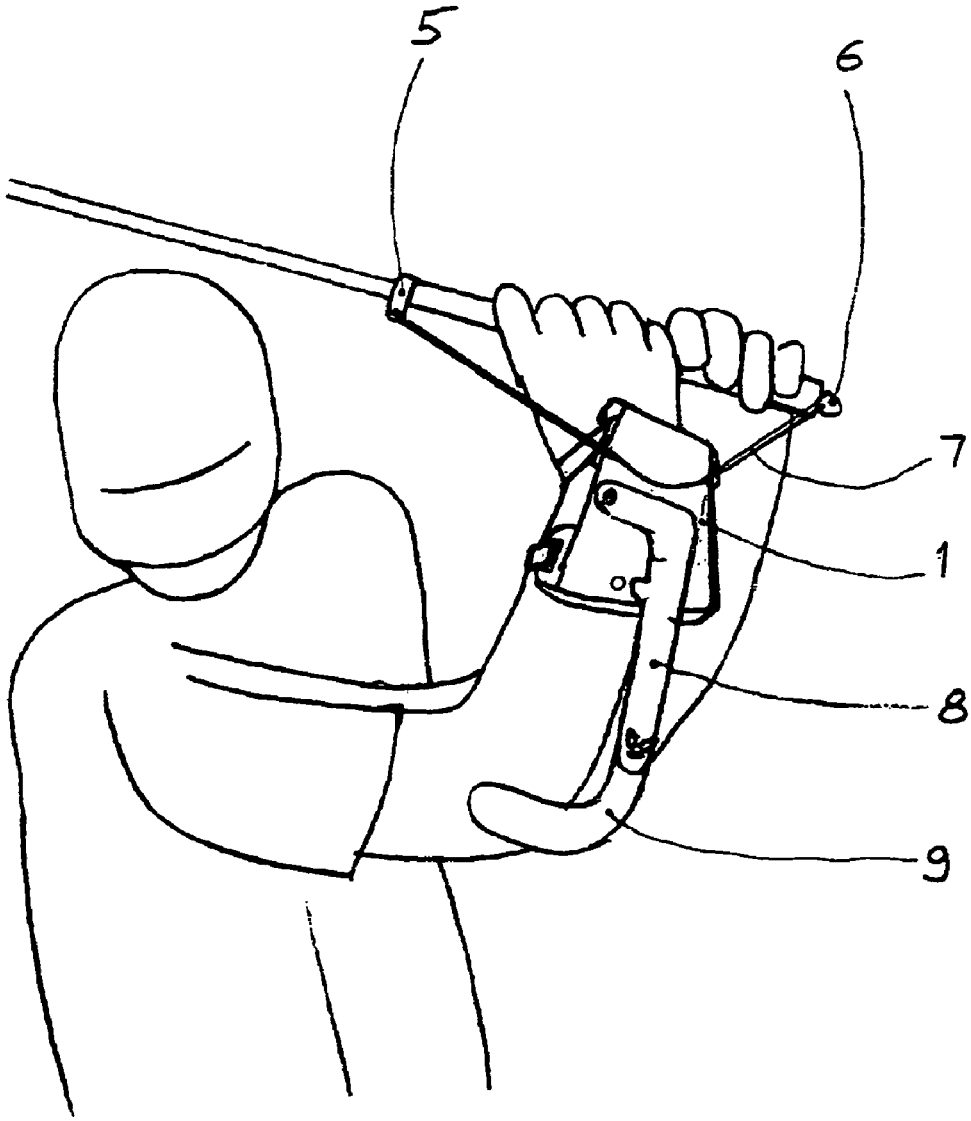
FIG. 4 is a front view showing the fully hinged position at the top of the follow trough when the control lever has been latched in a position which releases the linear element.

In FIG. 4, the swing is complete, and the wrists have hinged again. Because the control lever is in the release position, the cord remains free to shift in other direction. The golfer can return to the original address position by simply unhinging the wrists. To start the next training swing, the control lever 8 must be manually returned to its active position which it occupied before the body contact occurred. This can easily be done with the left hand for a right-handed player and with the right hand for a left-handed player.

Figure 5:
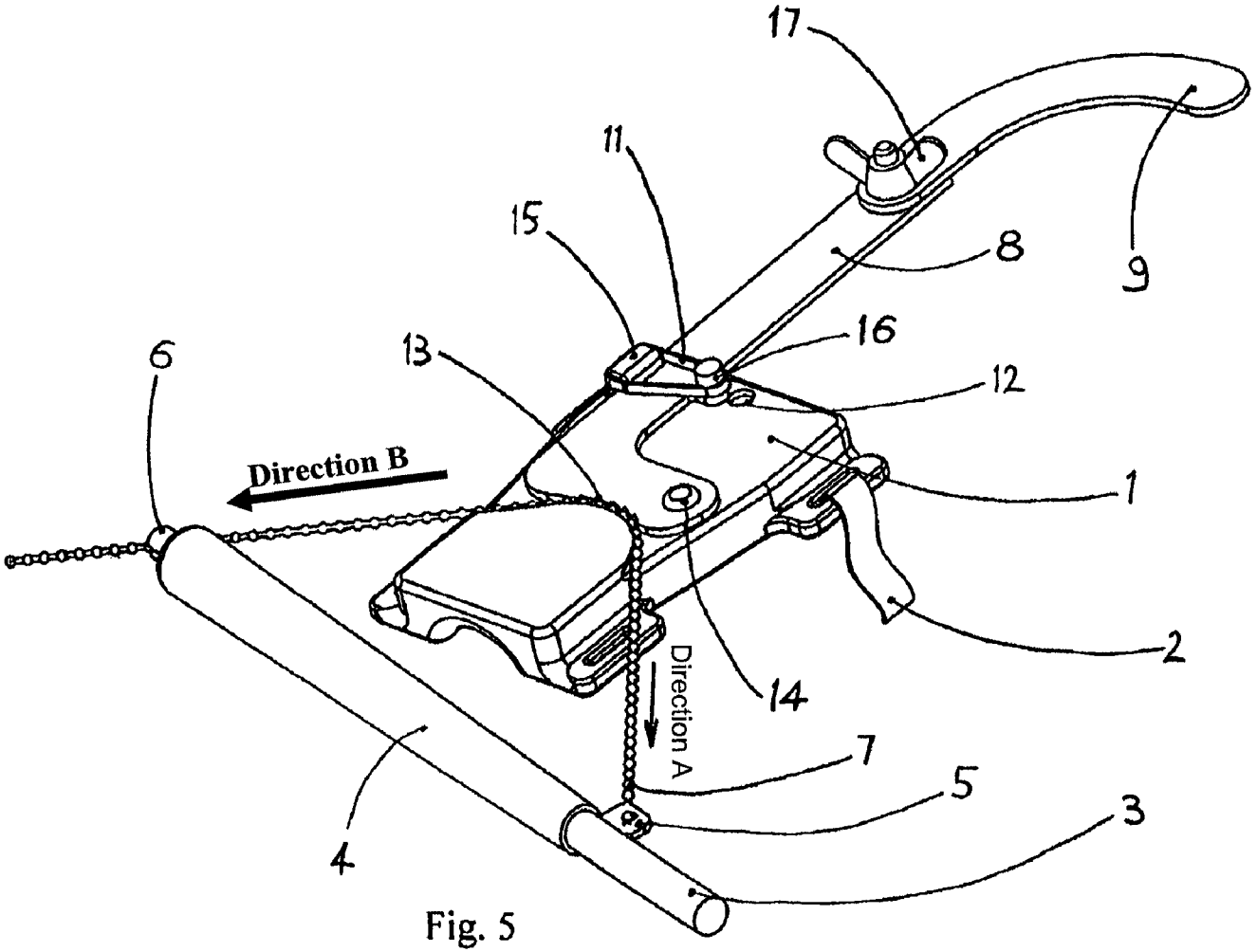
FIG. 5 is a perspective view of one embodiment of a swing training device embodying various features of the invention in association with grip end of a golf club.

Shown in FIG. 5 is one embodiment of a swing training device. The main body 1*a* of the device 1 is attached to the distal end of the forearm of the swinger along the top or back surface. The main body 1*a* is formed with a concave cavity 13 that is designed to accommodate the ulna of the right forearm for a right handed swinger, or over the left ulna of the left forearm for a left handed swinger. The main body 1*a* is secured in its operative position by more than one strap. These straps 2 may use a Velcro fastening system or any other securing method.

When the device is secured in position, the swinger takes hold of the club by gripping the lower region of the grip of the club 4 with the hand of the arm on which the device is attached. With the other hand, the swinger pulls the special cord 7 in direction B until tight. The special cord 7, which has one end attached to connector 5 that is on the shaft just below the grip 4 on the club 3, has its other end attached to the other connector 6. This connector is located above the grip 4 at the butt end of the club 4. This connector 6 is so designed that the cord can be slipped into a specially designed slot where it will remain clamped in this position throughout the swing. Once the specially designed cord is secured in position, the golfer grips the club 3 with the other hand on top region of grip 4.

The device is ready, and the swing can begin. As the hinging of the wrists takes place the cord will be moved in the direction of arrow A. This movement is permitted as the control lever 8 has teeth or detents with caroming surfaces that allow the specially designed cord to pivot the lever against the force applied by an elastic band 11. For example, a saw-teeth design 13 of the control lever 8 permits a special cord 7, which can be of a design involving small balls strung along a strong wire, such as used in electric light pulls, to slide in direction A as the wrists are cocked (hinged). The special cord can be made of steel, plastic or a combination of the two.

Lever 8 is attached to the main body 1*a* by a pivot lever pin 14, and it is prevented from pivoting or rotating counterclockwise (FIG. 5) by stop 15 against which it is seated by an elastic band 11 which encircles the stop and an upstanding boss 16 on the control lever. The adjustable component 9 of the lever 8 is secured in desired position by a screw, washer and wing-nut assembly 17.

When the adjustable component 9 of the lever 8 makes contact with the swinger's body, it will apply sufficient force to overcome the seating force of the elastic band 11 and will pivot the lever to a new position where a small protrusion formed on the undersurface of the lever 8 will enter an indentation or cavity 12 on the body 1*a* causing the lever to remain latched in this new release position.

With the lever in this position, the specially designed Cord 7 is no longer restrained by the saw-teeth 13 onlever 8, so the cord can now shift in direction B, allowing the swinger to unhinge the wrists.

To start a new swing, the control lever 8 must be slightly twisted to unlatch the protrusion from its temporary residence in the indentation 12 and thus return the control lever to its active position, seated against stop 15.

Figure 6:
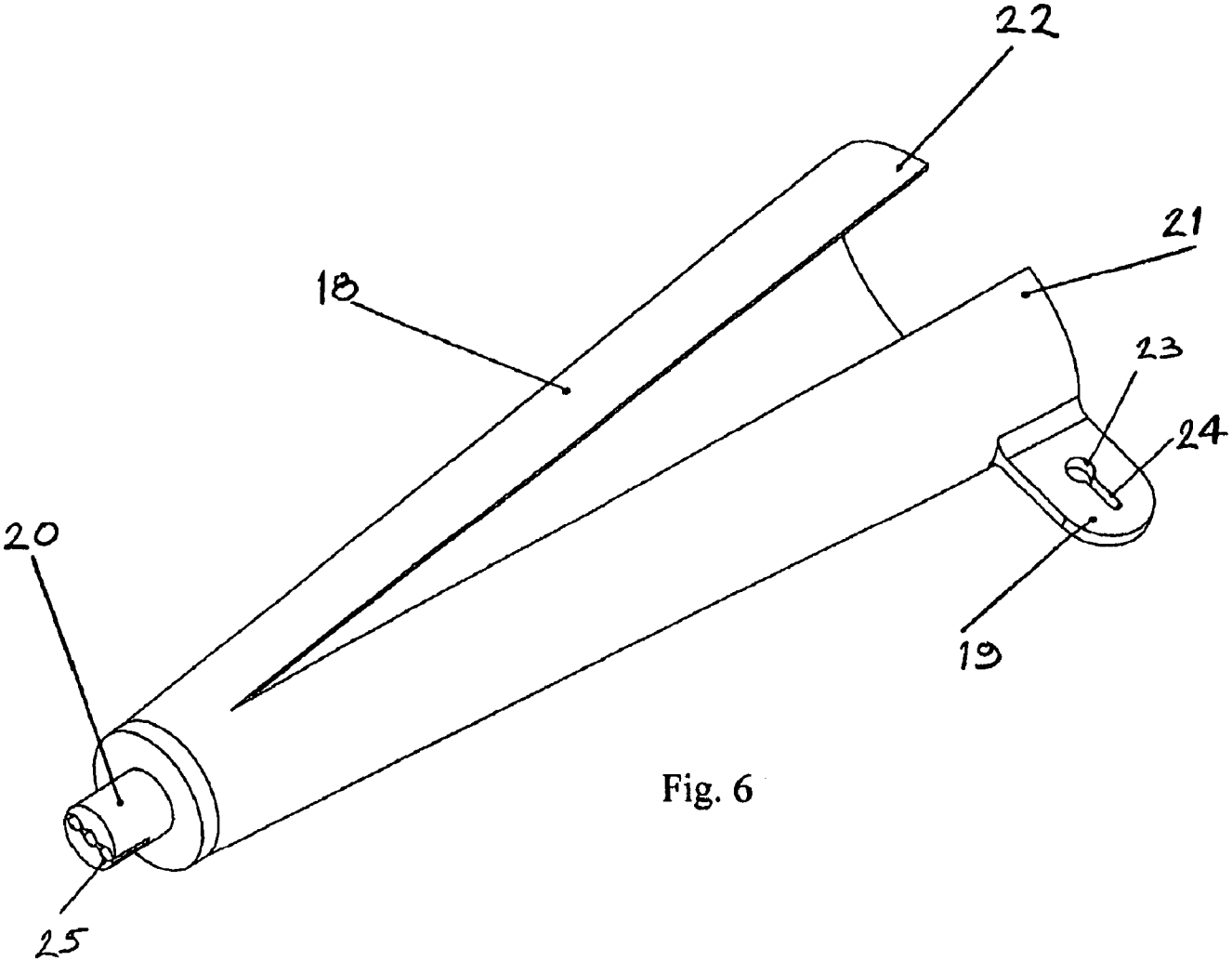
FIG. 6 is a perspective view of one embodiment of a specially designed overwrap unit, which can be wrapped on a standard grip of any club, making it possible to quickly install the training device upon a golfer's favorite club or a swinger's bat.

Shown in FIG. 6 is an embodiment which is an alternative to the separate installation of the connectors 5 and 6 to the grip region of a golf club 3 as shown in FIG. 1 for use as a part of a swing training device. A specially designed overwrap unit 18 is provided which can be wrapped on a standard grip of any club, making it possible to quickly install the training device upon a golfer's favorite club or a swinger's bat.

The overwrap unit 18 illustrated in FIG. 6 is designed to be installed over the grip end of a standard club so that it simply envelops the present grip, with the closed end of the generally tubular body of the unit seated against the butt end of the shaft so that an upper connector part 20 of the unit protrudes there from. A flat, apertured lower connector 19 extends radially from the pliable tubular body, which is split along its length to allow one edge of the split body to be wrapped over the other. The body of the unit 18 may be made of thin polymeric material of the type that adheres to itself, such as is marketed for overwrapping the grip portion of tennis racquet or the like; alternatively, it can be made of any suitable thin, flexible material. After being fitted onto the club, with the edge 22 of the overwrap unit in place on the grip, the edge 21 is wrapped over the edge 22 to tightly envelop the grip. If the material is not of the self-adhering type, it can be held in place with tape if desired, or the grip of the swinger will simply secure it in place as long as the club is being held. Alternatively, the tubular body might be made of elastic material which could be stretched to allow it to be installed like a sheathing over the grip end of the club.

The linear element or special cord 7 is then installed as before. If, for example, the linear element is a ball chain, one end of it can be inserted through a keyhole slot 23 in the connector 19 with clearance being provided in the round section and insertion into the narrow slot portion 24 securing the linear element 7 at the desired location along its length. The other end of the linear element 7 is then received in a specially designed slot 25 in the end of the upper connector 20, which slot is contoured to the configuration of the linear element or cord.

Figure 7:
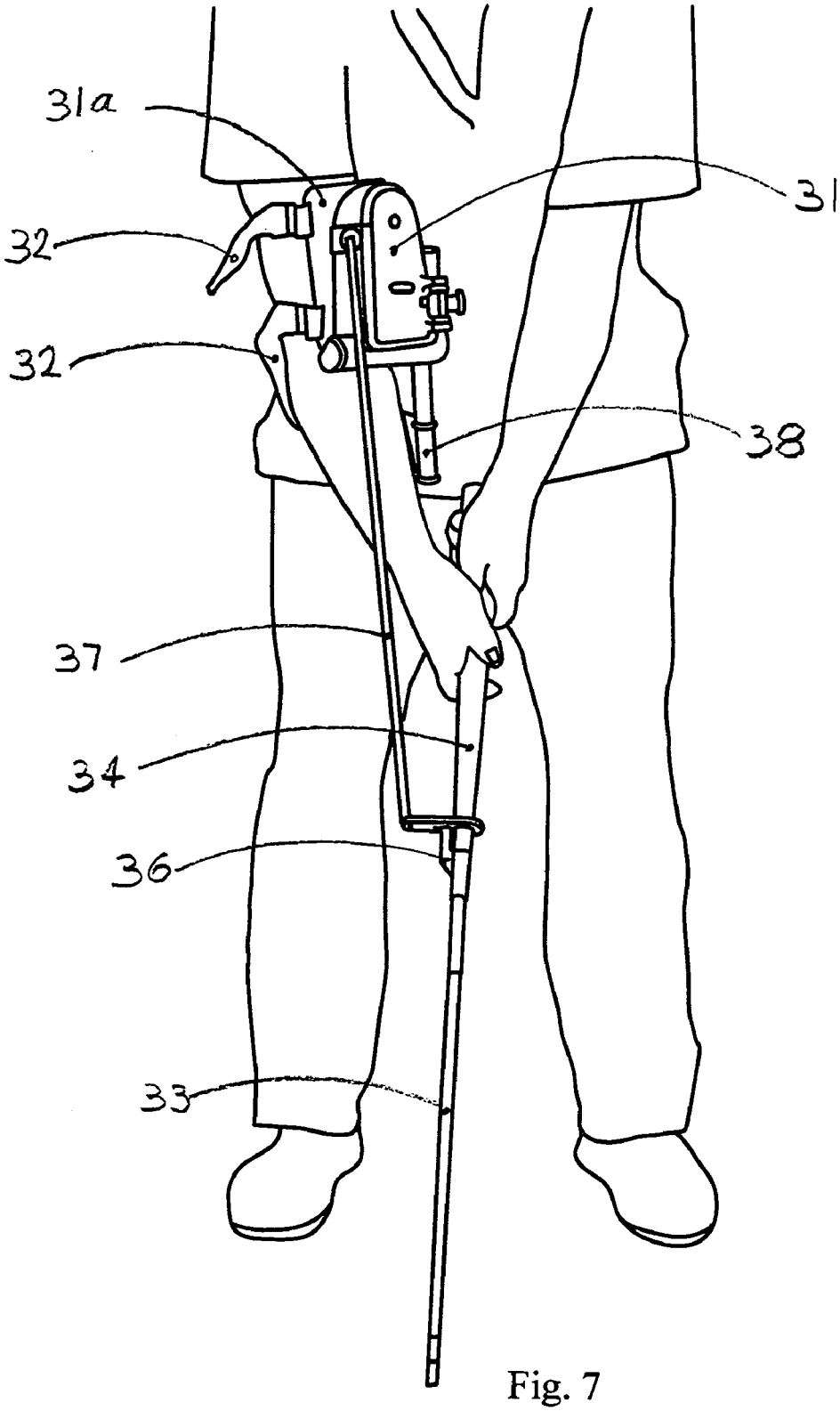
FIG. 7 is a front view of a golfer, similar to FIG. 1, with an alternative embodiment of a right handed, swing training device embodying various features of the invention attached to the golfer's right arm and connected to a golf club.

An alternative embodiment of this invention is illustrated in FIGS. 7-12. FIG. 7 shows a golfer in the address position with an alternative embodiment of a swing training device 31 attached to his right arm. A main body 31*a* of the swing trainer device 31 is attached by two straps 32 to the front or upper surface of the upper arm just above the elbow with a portion of the device extending to the inner side of the elbow. Because the golfer is a right handed player, the swing training device 31 is attached to the right upper arm as he/she grips a golf club 33 and prepares to start the backswing. A linear element or special tape 37 extends between a connector unit 36 that is attached at a grip 34 of the golf club 33 and the main body 31*a*. The connector unit 36 is seated at the lower end of the grip region and is oriented to extend transverse to the shaft of the club in a direction away from the golfer's stance in the address position (i.e. to the right of the shaft for a right-handed golfer). The special tape 37 is routed into the main body of the device 31 where it is retracted by a spring-loaded mechanism. A control lever arrangement 38, shown in its active or restraining position, extends from the main body 31 a where the tape 37 is restrained so that it can shift in one direction only.

Figure 8:
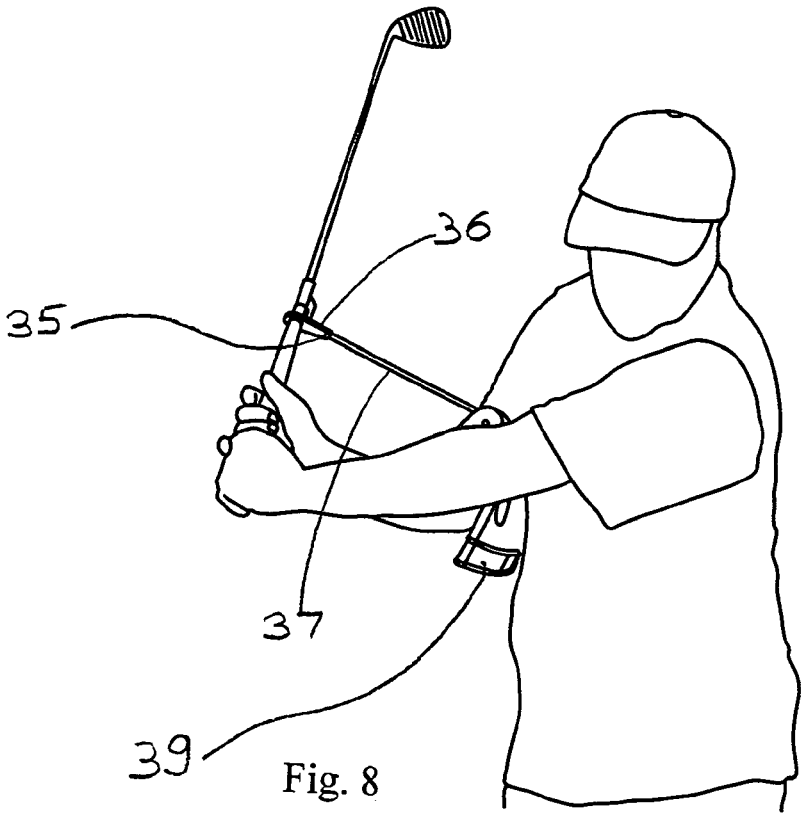
FIG. 8 is a front view showing the upper torso of the golfer of FIG. 7 with his arms in the fully hinged position at the top of the backswing, wherein a linear element that is part of the device is locked in its most highly shifted position.

At the top of the backswing, as shown in FIG. 8, the tape 37 has shifted linearly relative to the device, its one end having been retracted into the main body 31 a by a spring-loaded mechanism, and it is now locked in such position with only a minimal length of tape extending between the connector 36 and the main body. In this position, the tape 37 is restrained from moving in the opposite direction, i.e. from extending. The golfer's wrists are now fully hinged, and the only forward movement that is now possible from this position is downward movement of the arms while the fully hinged position of the wrists is maintained because of the now shortened length of the tape 37. This is a very important stage of the swing, and the golfer will now be able to experience and feel a correct start of the forward and downward swinging action.

Figure 9:
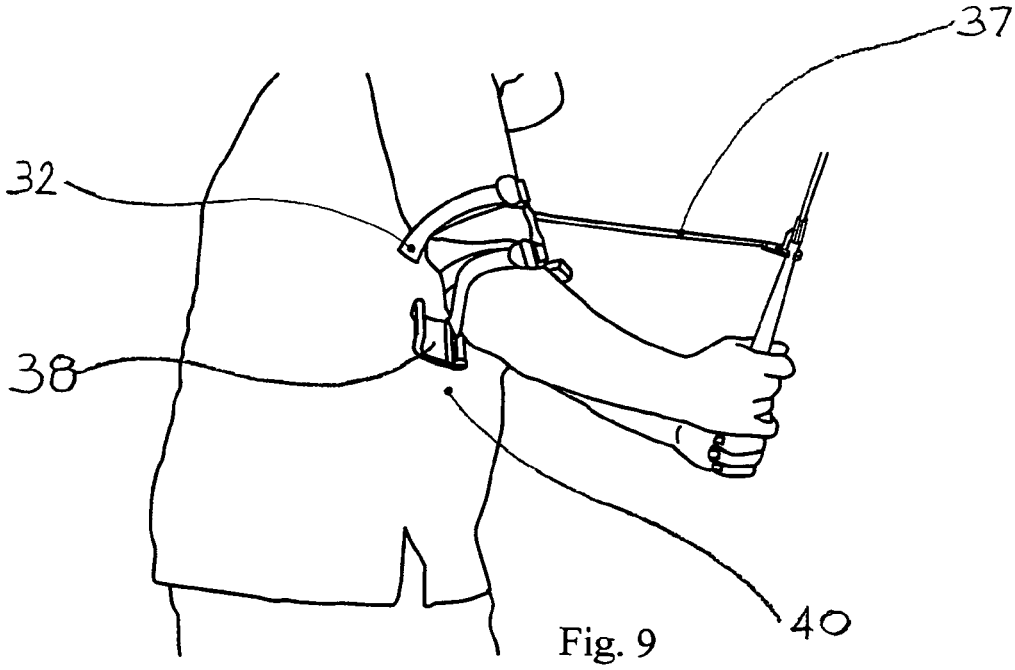
FIG. 9 is a right rear side view of the golfer of FIGS. 7 and 8 showing the position of the arms when contact occurs between a control lever that is part of the device and the body of the golfer at the exact point in the golfer's forward swing when it is desired that such lock be released so the golfer's can begin unhinging the wrists to accelerate the club head.

FIG. 9 shows the position of the golfer's swing at which the locking of the restraining tape is about to be released by action of the control lever arrangement 38. The control lever arrangement 38 includes an adjustable component or arm 39 and is constructed and mounted to allow the adjustable component to be positioned so that it will make contact with the torso 40 of the golfer at the predetermined position in the golfer's swing when unhinging at the wrists should begin. This contact with the torso will shift the control lever 38 and release the locking of the restraining tape 37 so that the wrists will then be free to un-hinge, which actions allow the club head to be moving at high speed when contact with the ball occurs. Should the swinger feel that the release took place a bit too early or too late, he/she can simply adjust the position of the adjustable arm component 39 of the control lever arrangement 38, e.g. by rotating its shaft portion a few degrees, so that slightly earlier or later contact will occur with the body 40 and thus change the timing of release.

Once the control lever 38 has been caused to pivot by the momentary body contact by the adjustable component 39, the device enters a release position where the tape will not be restrained, i.e. the device becomes latched in this release position. In this release position, the mechanical mechanism no longer locks the tape 37 against extension, and the tape is free to extend or to later retract guided by the spring-loaded mechanism.

Figure 10:
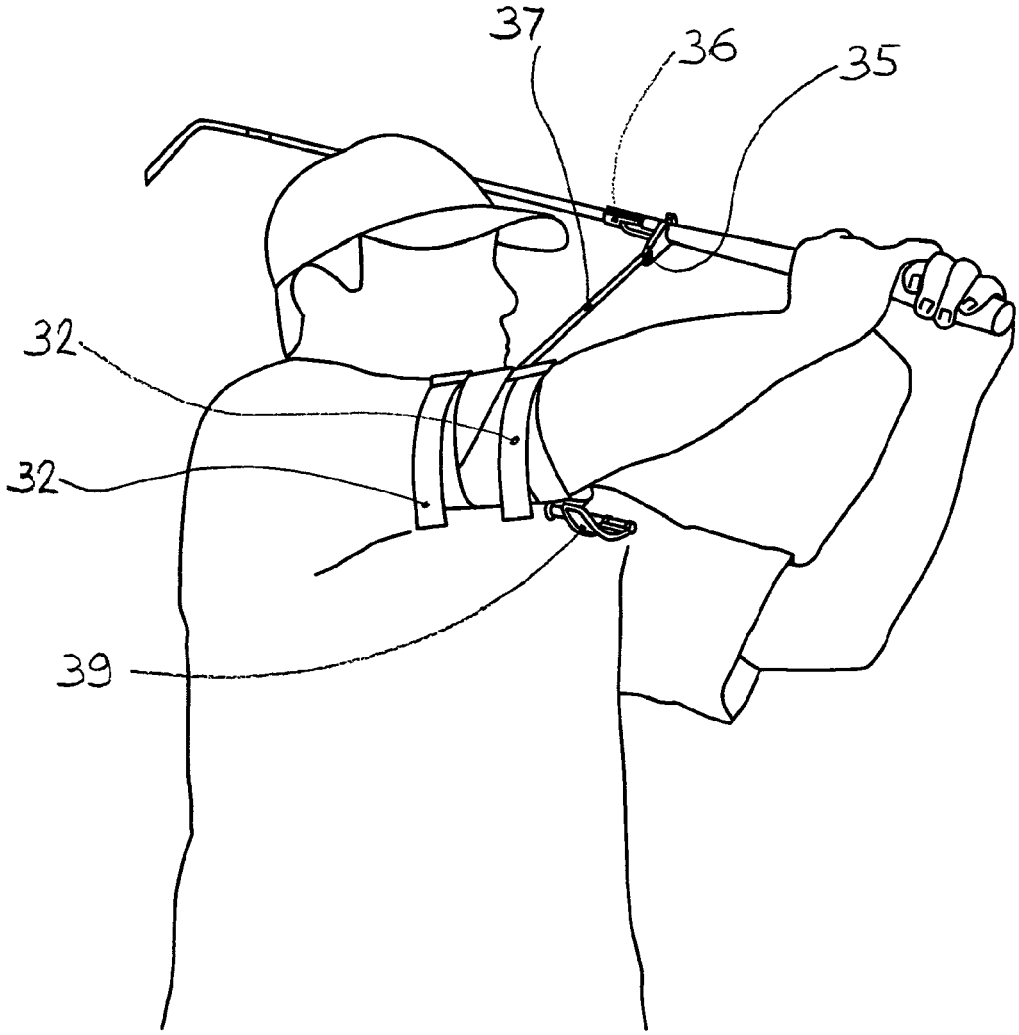
FIG. 10 is a right front view showing the position of the golfer's arms at the top of the follow-through with the control lever depicted in a latched position wherein the linear element is released.

In FIG. 10, the swing is complete, and the golfer's have hinged again. Because the device remains in the release position, the tape 37 remains free to extend against the action of the spring-loaded mechanism and the golfer can return to the original address position by simply unhinging the wrists. To start the next training swing, the device 31 must be manually returned to its active or restraining unlatched position which it occupied before the body contact occurred. In the illustrated device, this is accomplished by manipulating a latch that has a button 42 which protrudes through an opening in the casing of the main body 31 a on the upper surface thereof. This can easily be done with the left hand for a right-handed player or with the right hand for a left-handed player once the club is in the address position.

Figure 11:
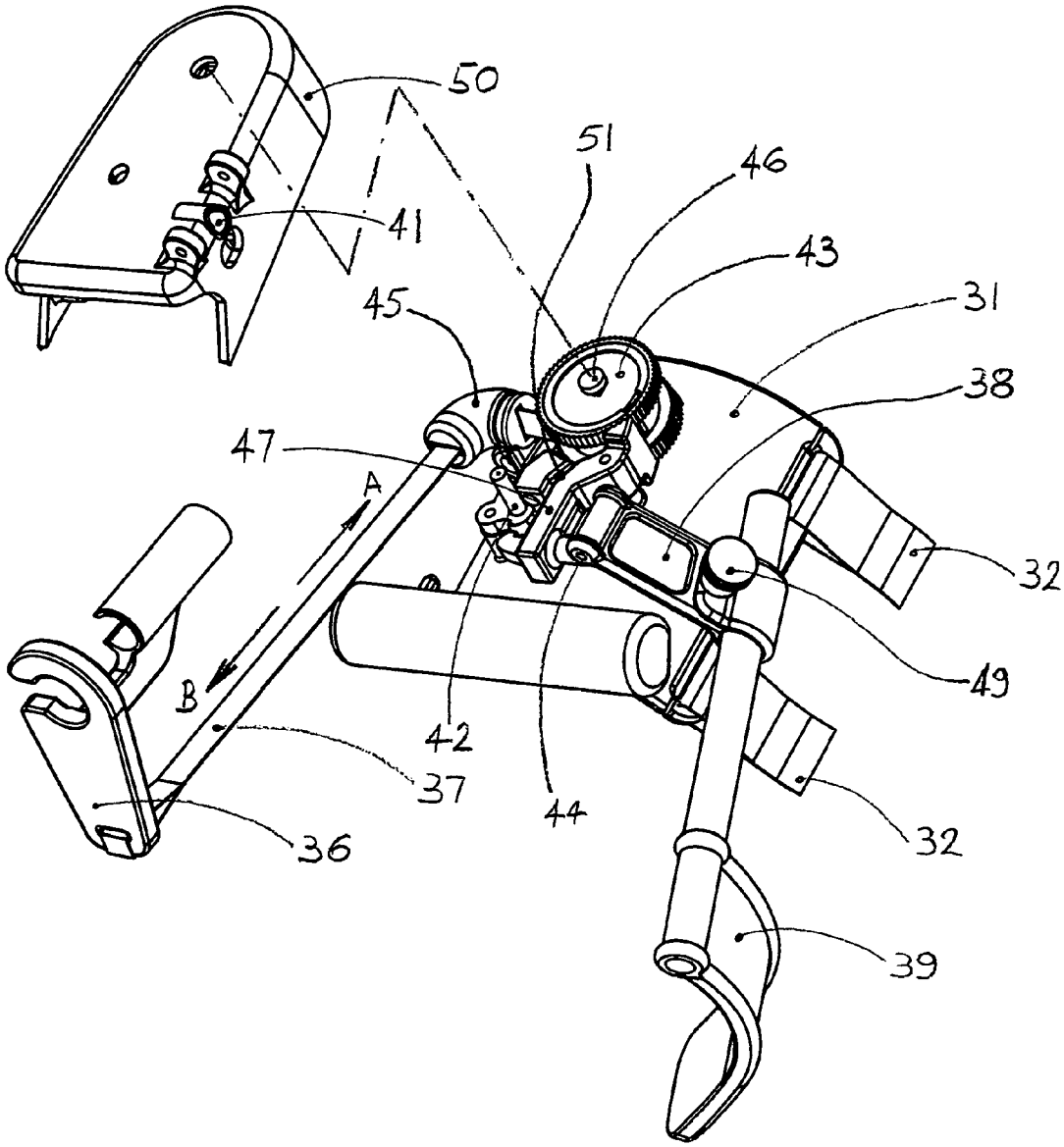
FIG. 11 is an exploded perspective view of the embodiment of the swing training device embodying various features of the invention that is illustrated in FIGS. 7-10 in association with the grip end of a golf club.

Shown in exploded perspective in FIG. 11 are various mechanical components of the swing training device 31. The main body 31 a of the device 31 is attached to the upper or front surface or the upper arm of the swinger. A base portion of the main body 31*a* is formed with a concave contour that is designed to seat upon the upper surface of the upper arm of a swinger, e.g. a golfer. The main body 31*a* is secured in its operative position by at least two securing straps 32 which may use a Velcro fastening system, D-rings, Tri-loops, Keepers, or any other suitable securing method.

When the device 31 is secured in position, the swinger takes hold of the club by gripping the grip 34 of the club 33 with the hand of the arm on which the device is attached. With the other hand, the swinger can, if necessary, pull the special tape 37 to extend it in direction B until it is tight in the adverse position. The special tape 37, which has one end attached to connector 36 located near the lower end of the grip region on the club 33, is now secured in position, and the golfer grips the club 33 with the other hand on upper region of grip 34.

The training device 31 is now ready for the golfer's swing to begin. As the hinging of the golfer's wrists takes place, the tape 37 will be automatically retracted in the direction of arrow A (FIG. 11), by the spring-loaded mechanism. This movement is permitted and directed by the spring-loaded ratchet mechanism. The tape 37 is preferably a flat tape that may be made of fiber, nylon, plastic or a combination of these. The ratchet mechanism includes a spiral spring-loaded toothed gear or wheel 43, rotating on a center pin 46 mounted on the base of the main body to retract the tape in direction A and wrap it thereon by clockwise rotation as the wrists become cocked (hinged). The tape 37 is wound centrally on the gear shaft between the two sections of the split gear 43. The control lever 38 includes a linkage that pushes against a pivot element 47 that has one end shaped to function as a pawl which is mounted so as to engage the gear teeth and allow rotation in only one direction.

Figure 13:
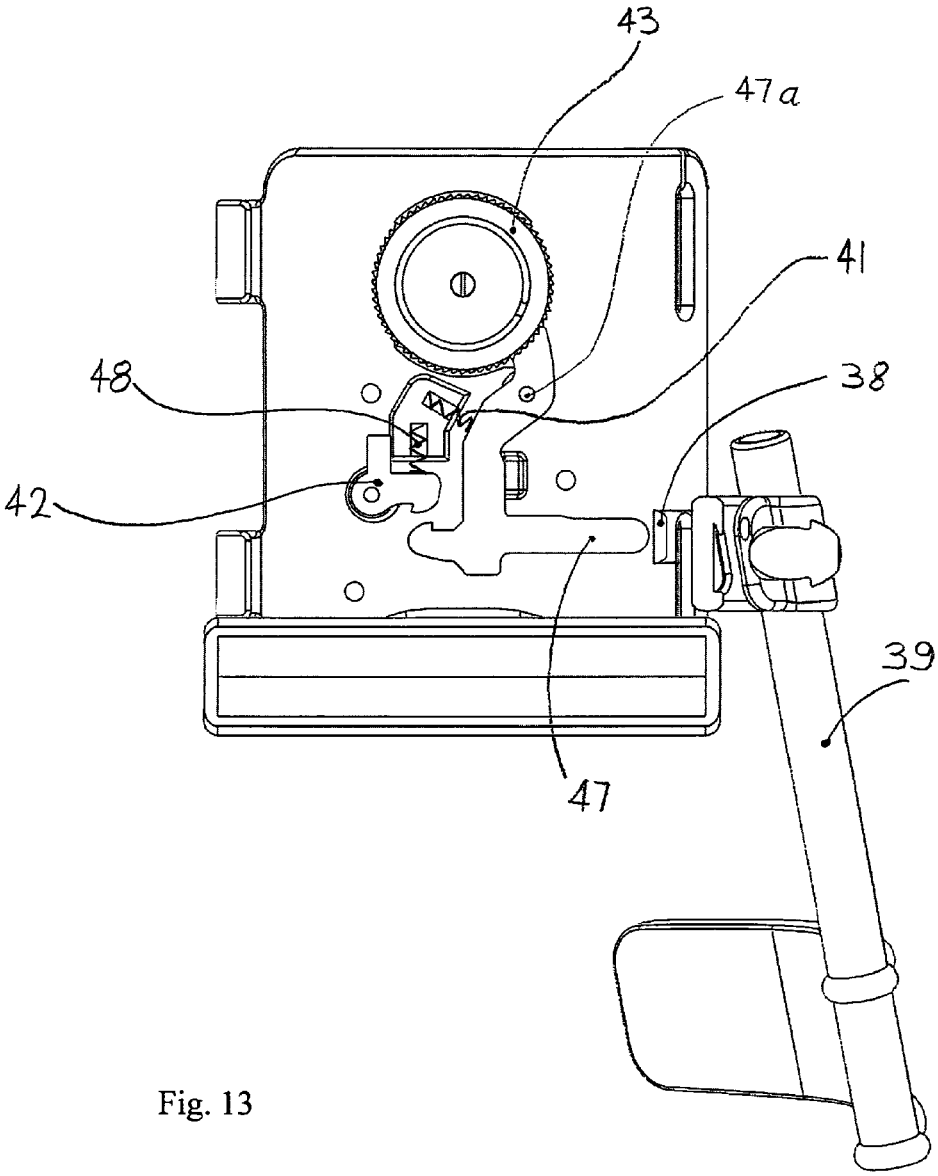
FIG. 13 is an enlarged schematic view showing springs, levers and latches in the main body of the device and the control lever.

The main body of the control lever arrangement 38 includes a hinge connection 44 that is part of the linkage which engages the pivot element 47. As best seen in FIG. 13, the pivot element 47 is pivotally mounted to the base of the main body 31 a on a pin 47*a*. It is prevented from pivoting or rotating too far in the opposite direction (FIG. 11) by a stop 51. It is biased to the active position by a coil spring 41 which pivots it so that the pawl end seats against the toothed gear 43. The adjustable arm component 39 is secured in its desired angular position within a coupling at the other end of the main body of the control lever arrangement 38 by a screw, washer and hand nut assembly 49.

When the adjustable arm component 39 makes contact with the swinger's body, sufficient force is applied through the linkage to overcome the force of the coil spring 41 so as to pivot the pivot lever 47; this moves the pawl and frees the ratchet gear 43, allowing the tape 37 to now be pulled in the direction B by the golfer as he/she uncocks the wrists.

Such angular movement of the pivot lever 47 will trigger the latch 42 that is biased by a spring 48 to the engagement position. The pivot element 47 is latched in this release position when a hook section of it interengages with the latch 42. As a result, the spring-loaded gear 45 continues to be free to rotate and release the tape to extend in direction B. This allows the swinger to complete the forward swing and the follow-through without any restriction by the tape 37. When the club is returned to the address position, the latch 42 is released by one turning the button portion counterclockwise as seen in FIG. 13.

Figure 12:
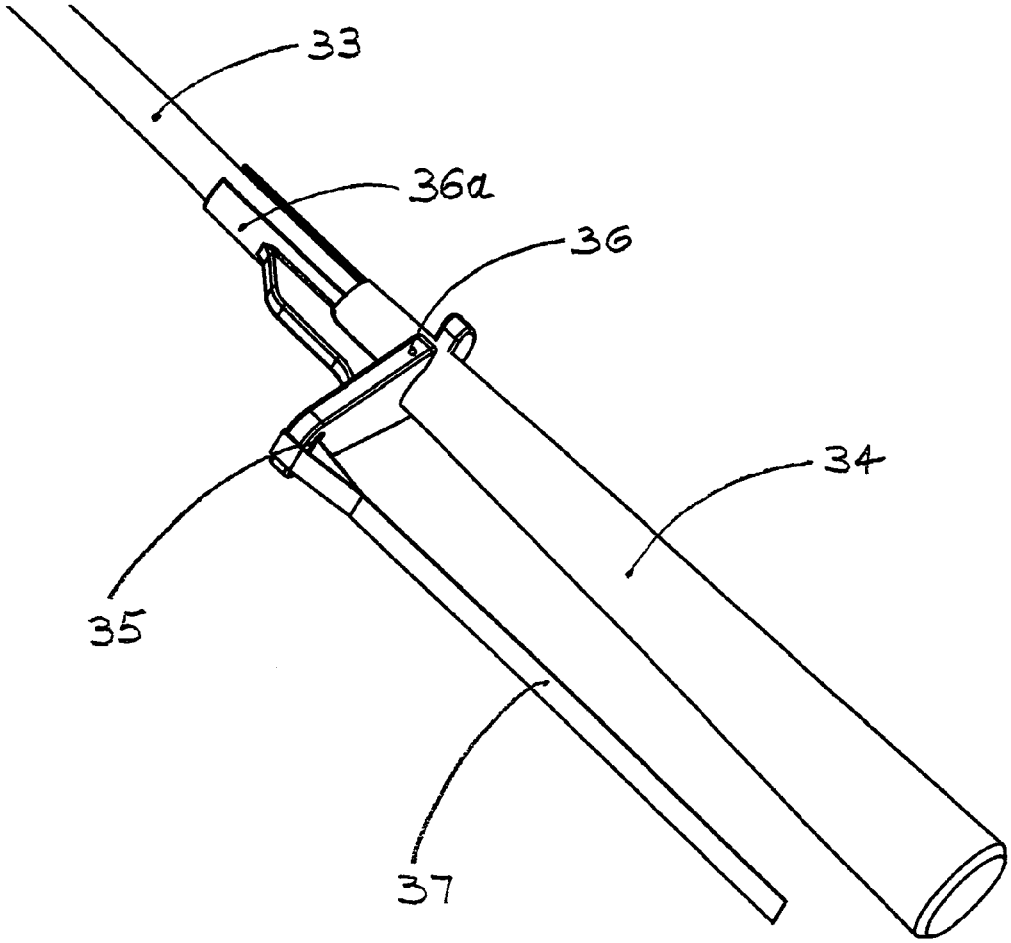
FIG. 12 is a perspective view showing a specially designed connector, as seen in FIG. 11, installed near the lower end of a standard grip of a golf club.

Shown in FIG. 12 is one embodiment of an installation of a connector 36 (also seen in FIG. 11) located on a golf club shaft 33. The connector 36 includes a split sleeve 36*a* that is received on the shaft just below the grip 34 region of a golf club. The tape 37 is connected and secured to the connector through a slot 35 at one end of the body portion of the connector 36. The club connector 36 can easily and quickly be removed by sliding it away from the grip along the shaft 33 to a location where the shaft becomes smaller in diameter allowing the sleeve 36 to be removed from the club through the slot therein. This makes it possible to quickly install the connector on another club or on a different swinger's club or bat. The sleeve portion 36 preferably has some resiliency so as to tightly grip the shaft or bat; however, it should have sufficient rigidity to prevent unintended detachment.

Particular features of the invention are emphasized in the claims that follow.

The invention claimed is:

1. A golf swing training device which comprises:

a main body adapted to be secured to a player's arm, means for securing said main body to the player's upper arm, a connector for installation on a shaft of a golf club near the lower end of its grip region, a linear element connected at one end to said connector and routed into said main body where an opposite end of the said linear element resides so that said linear element extends between said connector and said main body, a mechanical restraining mechanism in said main body to which said opposite end of said linear element is connected, which restraining mechanism includes a ratchet mechanism that includes a toothed gear and that allows linear movement of said linear element in only one direction, and a control lever arrangement which includes a pivot element that is connected to said main body and spring-biased to an active position where it activates said mechanical restraining mechanism to restrain extension movement of said linear element in a direction opposite to said one direction, which arrangement effects release of said restraining mechanism when a portion thereof comes into contact with the torso of a player at a desired moment during the player's swing.

2. The device of claim 1 wherein said control lever includes an adjustable component which adapts the device to players of different size and permits rotation to adjust when contact occurs with the player's torso.

3. The device of claim 1 wherein said main body includes a releasable latch element which is positioned and biased to an active position so that said control lever arrangement becomes latched in a release position following said contact with the player's torso.

4. The device of claim 1 wherein said pivot element is pivotally connected to said main body and spring-biased to cause a pawl portion thereof interengage with said toothed gear.

5. The device of claim 4 wherein said toothed gear includes spaced apart gear sections with a shaft extending therebetween.

6. The device of claim 5 wherein said linear element is a flat tape with said opposite end thereof being wound upon said toothed gear shaft.

* * * * *